US005924230A

United States Patent [19]

Hoke, Jr.

[11] Patent Number: 5,924,230

[45] Date of Patent: Jul. 20, 1999

[54] RESILIENT BREECH FIREARM

[76] Inventor: Clare L. Hoke, Jr., 1318 N. Monte Vista Ave. #11, Upland, Calif. 91786

[21] Appl. No.: 09/039,955

[22] Filed: Mar. 16, 1998

Related U.S. Application Data

[63] Continuation-in-part of application No. 08/680,619, Jul. 17, 1996, abandoned.

[51] Int. Cl.[6] ..... F41C 3/14

[52] U.S. Cl. ..... 42/60; 42/59; 42/39.5

[58] Field of Search ..... 42/60, 59, 69.01, 42/75.02, 39.5; 89/125, 155, 164

[56] References Cited

U.S. PATENT DOCUMENTS

| | | | |
|---|---|---|---|
| 12,648 | 4/1855 | White | 42/60 |
| 2,865,126 | 12/1958 | Dardick | 42/60 |
| 3,496,827 | 2/1970 | Dardick | 89/8 |
| 4,437,250 | 3/1984 | Beretta | 42/59 |
| 5,092,069 | 3/1992 | Walker | 42/59 |

*Primary Examiner*—Charles T. Jordan
*Assistant Examiner*—Meena Chelliah

[57] ABSTRACT

A firearm which exhibits the geometric inability to jam. Further, the nature of the described firearm insures increased safety, versatility of calibers, ease of loading, higher potential capacity, unique gas operations, and reduced perceived recoil, over designs presently employed in the art of firearms manufacture.

11 Claims, 2 Drawing Sheets

RESILIENT BREECH FIREARM

RELATED APPLICATIONS

This application is a continuation-in-part of my application Ser. No.08/680,619, filed Jul. 17, 1996 entitled "The Automatic Revolver", abandoned on Oct.26, 1998.

BACKGROUND OF THE INVENTION

1. Field of the Invention

This invention relates to firearms, specifically a new type of firearm mechanism.

2. Description of Prior Art

The art of firearms manufacturing has a long history of evolution dating back from the earliest single shot blunder busts, to flintlocks, and up to modern fully automatic weapons.

An early hybrid firearm was invented by George Fosbery, with a patent applied for in 1895. This design was a revolver with a mechanism to self cock the hammer after each shot. In production it was known as the Webley Fosbery, and proved to be less rugged than desirable.

Today, evidence of the evolutionary struggle is pronounced in the manufacture of double action, semi automatic firearms. Those versed in the history of the transition of the revolver to the semi-automatic handgun may attest to the tradeoffs inherent to each design. In the case of small arms, semi automatic pistols and rifles commonly encounter feeding problems transitioning cartridges from the firearms magazine to its breech, rendering the firearm temporarily inoperable. Traditional revolvers do not suffer such problems, but cannot be easily charged via removable magazines.

Since the reliability of the modern semi-automatic firearm has greatly improved over earlier designs many police agencies have been attracted to the higher capacity that semi-autos offer. The transition these agencies have made would never have occurred however, if the trigger actions of the modern autos had not been made to resemble the safe and subtle trigger actions of the revolver. It may be said without argument that each design has something to offer, and that each design has something to be desired.

In the 1950's Dardick pioneered the open chamber design. These firearms were incapable of using standard ammunition, and employed triangular plastic cartridges. The author of the present invention believes the use of standard cylindrical ammunition is more cost effective and renders the present invention more mechanically reliable than previous open chamber designs. Further features novel to the present invention distinguish it from prior art designs.

The present invention represents a new mechanism for firearms, designed to be the surest and safest mechanism to date.

SUMMARY OF THE INVENTION

Accordingly, several objects and advantages of the present invention are:

(a) the geometric inability to jam.

(b) an intrinsically safe and accurate firearm.

(c) quick, high capacity magazine feeding.

(d) desirable trigger actions.

(e) a mechanism capable of reliable high speed firing.

(f) the ability to fire the most powerful chamberings.

(g) lowered barrel axis to reduce recoil.

(h) the ability to carry the weapon in a ready state without having a round in front of the barrel and hammer, for improved safety.

(i) a controlled ejection of spent casings.

(j) the ability to use standard ammunition.

(k) a mechanism suitable for many types of firearms ranging from handguns and rifles to rockets.

DESCRIPTION OF THE PREFERRED EMBODIMENTS

Figure 2:
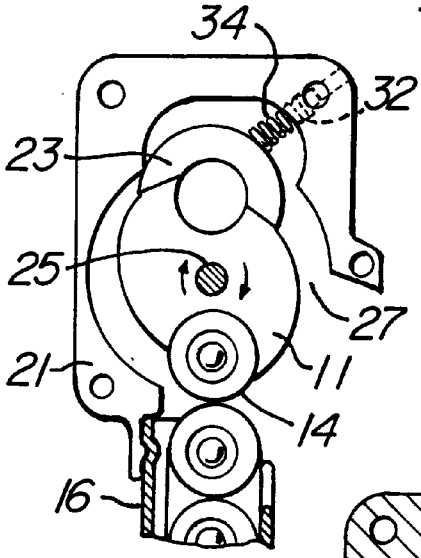
FIG. 2 is a cross sectional view of the internal components of the present invention.
Figure 3:
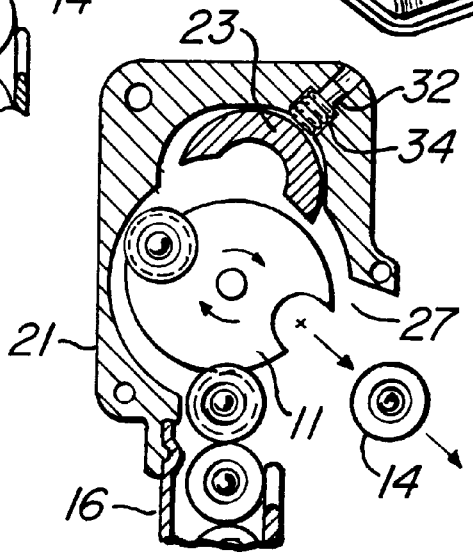
FIG. 3 is view similar to FIG. 2 showing the present invention moving through the loading and ejecting cycles.

FIG. 2 shows a perspective of the internal workings of the preferred embodiment of the invention. The central transporting mechanism, or transport drum 11 rotates about its axis, shaft 25, and is shaped to scoop cartridge 14 from magazine 16 and transport cartridge 14 into breech position directly in line with barrel 17. Breech housing 21 represents both an exterior and interior wall of the firearm and part of the transport system for cartridge 14 as cartridge 14 is pushed forward by transport drum 11, and pushed against breech housing 21. Breech housing 21 is shaped to work in conjunction with transport drum 11 to insure the geometric impossibility of cartridge 14 becoming off axis, pressing improperly against transport drum 11 and breech housing 21, and jamming between said parts.

As transport drum 11 moves towards the top of its swing in front of barrel 17, breech member 23 is pushed back by cartridge 14. At this time springs 34 are compressed as breech member 23 and guide pins 32 are driven upwards into the upper portion of breech housing 21. As cartridge 14 comes into position directly in front of barrel 17, breech member 23 is driven downward by springs 34, fully encasing cartridge 14 within transport drum 11 and resilient breech member 23. The resultant chamber formed by mating breech member 23 and transport drum 11 houses cartridge 14 during the firing part of the weapons cycle.

When pressures have returned to a safe level within the firearm after firing, breech member 23 and transport drum 11 again separate; transport drum 11 pivoting on shaft 25, and transport drum 11 and cartridge 14 again pushing assembly 23, 32, and 34, upwards into the upper portion of breech housing 21; far enough to allow moving the spent casing of cartridge 14 through the ejection cycle. To eject spent cartridge 14 from the firearm, spent cartridge 14 is moved against and eventually through port 27 in breech housing 21. From the ejection position adjacent to port 27 transport drum 11 moves on to complete its cycle, preparing to scoop another cartridge from magazine 16.

It should be apparent to anyone versed in the art of firearms that the mating surfaces of transport drum 11 and breech member 23 represent a significant increase in surface area associated with firearm timing and lock up as compared with a conventional revolver. Also that the inherent centering ability of this mechanism insures increased accuracy when encountering minor deficiencies in the correct sizing of ammunition casings.

In accordance with standards of modern firearm designs, the trigger mechanism of the present invention is intended to resemble in function the modern revolver in that either a long pull of the trigger, or a pulling back of the firearms hammer commences transport of fresh cartridges to the breech position of the firearm as is commonly understood in the art of firearms manufacture.

In the preferred embodiment of the invention transport drum 11 features two cartridge transport coves, or recesses. A particular advantage of the present invention is in allowing the weapon to be carried ready to fire, without a cartridge in front of the barrel (17) so as to prevent accidental discharge from dropping the weapon, or in some other way undesirably forcing the hammer down upon a loaded cartridge. In the state where a cartridge is in position to next be cycled to parody with the barrel, the weapon may be fired by a long pull of the trigger (double action). In this manner the firearm may be carried in an unloaded condition, while being ready for use without having to rack the slide, as would be in the case of a semi automatic firearm. In the case of a five shot revolver, this level of safety would necessitate a twenty percent reduction in capacity, i.e. leaving the chamber in front of the barrel empty.

A further safety feature of the present invention can be illustrated in the scenario wherein a cartridge of ammunition fails to discharge. In this instance conventional wisdom dictates waiting 10 seconds in case the cartridge is simply slow to ignite. In a stressful situation, the operator of a semi automatic weapon must take time to rack the slide to expel the faulty ammunition and chamber a fresh cartridge. In a stressful situation the operator of a conventional revolver must move on to the next cartridge which places the faulty cartridge in a position where it cannot escape the weapon should it discharge late, leaving the possibility of serious injury to the weapon and operator. In this scenario the present invention is capable of removing and replacing faulty ammunition quickly and safely.

Three or more cartridge recesses in the transport drum may be used in the present invention if it is found to be desirable, either for increased capacity, internal balancing, or as a manufacturing consideration to standardize parts and timings between different calibers of ammunition.

Figure 4:
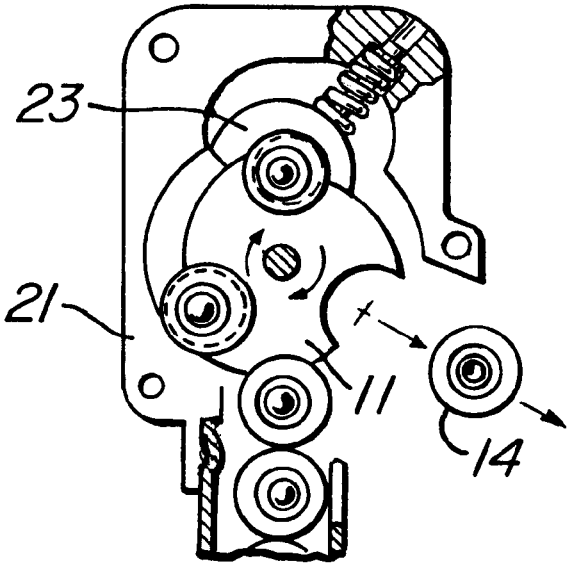
FIG. 4 shows a similar view to FIG. 2, wherein a third cartridge recess has been incorporated into the transport drum.

FIG. 4 illustrates the present invention with the modification of three cartridge recesses incorporated into transport drum 11.

Figure 5:
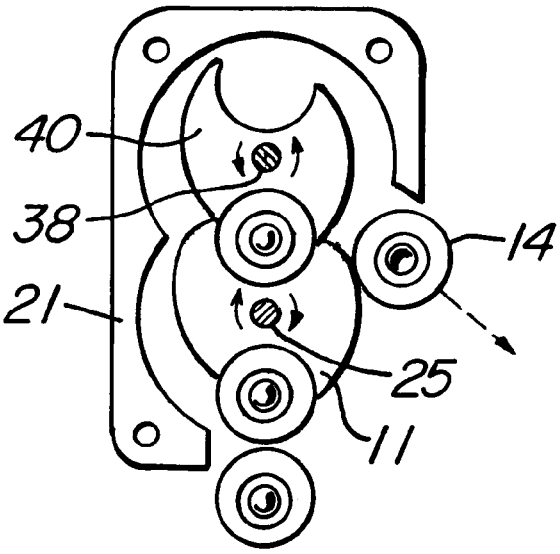
FIG. 5 shows a further modification in the same perspective as FIG. 2, wherein resilient breech member 40 employs two cartridge recesses and is capable of being lifted and rotated on axis of pin 38.

Likewise in the preferred embodiment of the present invention breech member 23 contains one mating surface, or recess, to house cartridge 14. It may be desirable for a particular caliber or application to place two or more cartridge recesses in breech member 23 as shown in FIG. 5. In this embodiment of the present invention, breech member 40 has been configured to move rotationally, around pin 38, and in harmony with transport drum 11. In this variation pin 38 is held in grooves in the frame of the firearm which allow vertical movement of pin 38 and breech member 40; said grooves also housing springs above pin 38 to insure said assembly returns to the breech position around cartridge 14 after each ejection cycle.

Figure 1:
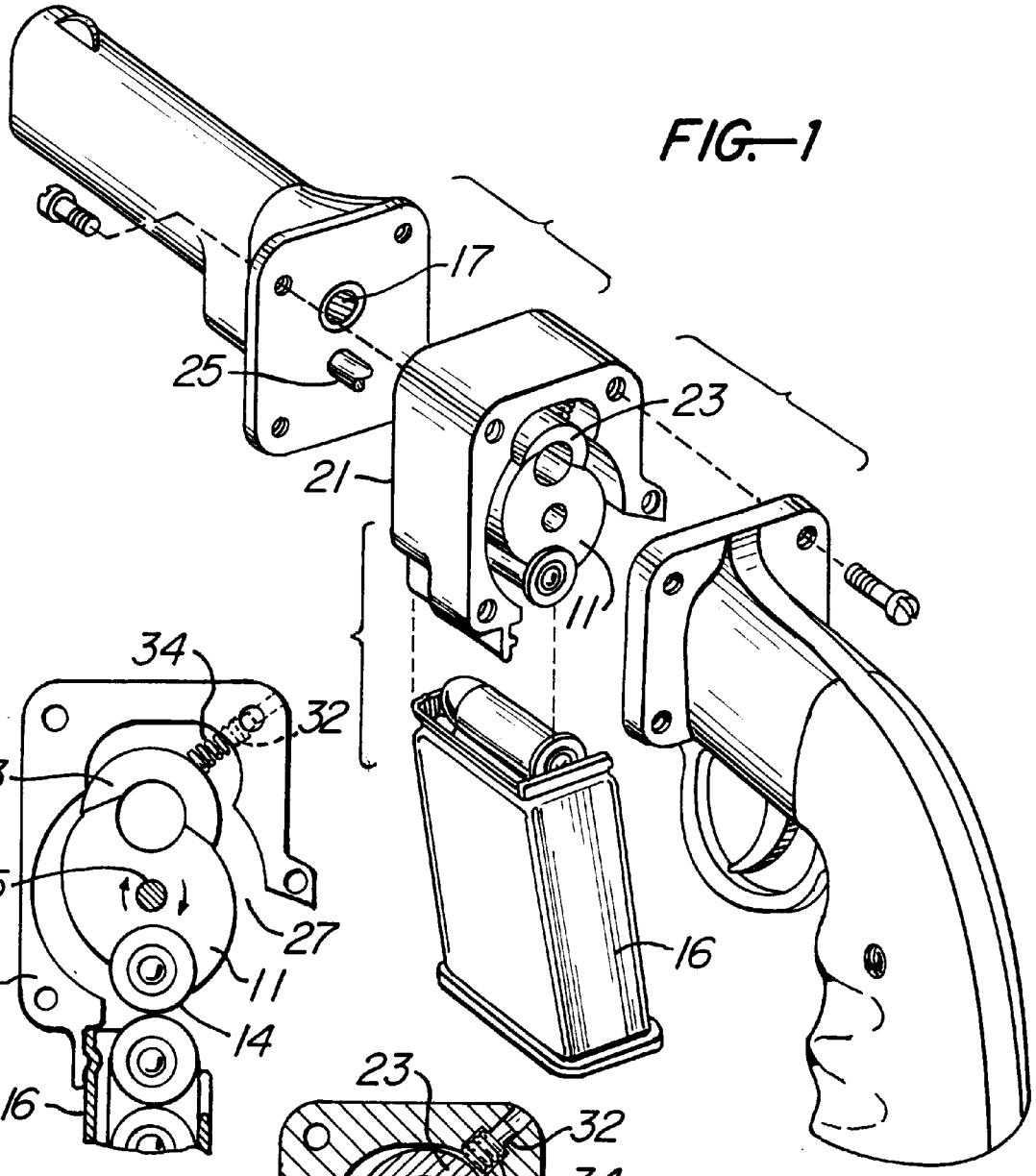
FIG. 1 is a exploded perspective view of the present invention wherein the magazine is located in front of the firearms handle.
Figure 6:
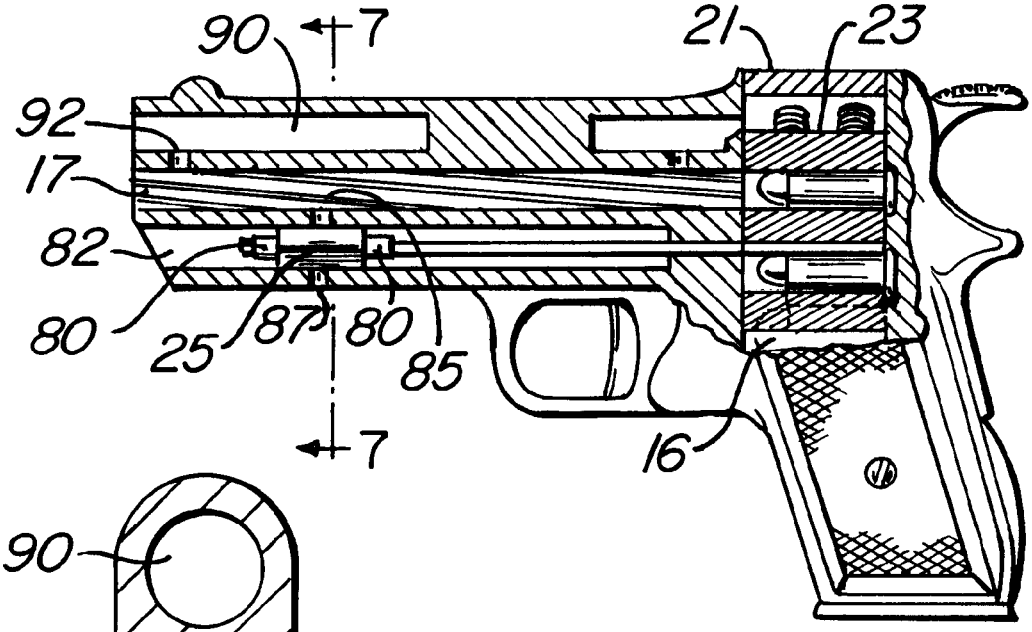
FIG. 6 is a side cut away view of the present invention incorporating three gas operating systems; and the use of a magazine in the handle of the firearm.

FIG. 6 depicts the internal configuration where the magazine (16) is inserted into the handle of the firearm. In FIG. 1 the magazine (16) is placed forward of the firearms handle. This optional design attests to the versatility of the present mechanism. In certain magazine capacities and calibers this configuration may be found to be desirable. For example, the renderings herein have been based upon the .357 magnum chamberings. The .357 caliber and the .44 magnum caliber approximate the largest practical caliber for a handle fed magazine. These calibers necessitate a large handle to store their magazines. Should a longer rifle style caliber be desired, such as the .223, which would match the ammunition used in military rifles, or should a double stacked magazine be desired, which has greater girth, but more capacity for its length, the magazine configuration described in FIG. 1 would then be desirable. Due to the versatility of the present invention, various embodiments render the present invention capable of chamberings ranging from small caliber bullets to missiles.

As the goal of the present invention is to produce a superior firearm, it is herein suggested in the preferred embodiment that a gas operating system be incorporated. It is commonly understood in the art of firearms manufacture that placing a small hole in the barrel of the weapon will divert gases as they are discharged from the ammunition. The energy from the said diverted gases are then used to drive a piston which will in turn push back the receiver and in short provide the energy to remove the spent casings and reload a semi automatic firearm. In the case of the present invention the gas operation is unique in that it provides rotational motion to the firearms mechanism, rather than lateral motion to the slide of a traditional semi automatic firearm. Herein it may be described that after the first shot is fired, either from a double action mode, (i.e. a long pull of the trigger wherein the mechanism brings the cartridge to bear in front of the weapons barrel and then discharges) or single action, (having previously moved the firearms internal mechanism to bring a cartridge to the firing position by pulling back on the weapons hammer, then releasing the hammer with a short pull of the trigger) in either case the gas operation then makes the firearm semi automatic by expelling spent cartridges, and reloading itself so that it may from that point on be fired in the single action mode.

A multiplicity of mechanisms may be employed to produce the rotational energy required to make the present invention self loading. As shown in FIG. 6, in the preferred embodiment of the invention, a gas operational section of the firearm is housed beneath barrel 17. Shaft 25 is shown to extend through bushing 80 and continue through chamber 82 in a paddle shaped impeller configuration. Gas port 85 forces expanding gases into chamber 82 upon firing. In chamber 82 expanding gases apply pressure upon said impeller, imparting rotational motion to shaft 25 and hence transport drum 11. Rotational motion of shaft 25 is brought to a stop as gas finally escapes the firearm through port 87. Hence rotational energy is imparted to transport drum 11 through the expansion of gases upon discharging of the firearm in the semi automatic mode, or manually, via the trigger mechanism, as would be commonly understood to anyone versed in the production of standard double action revolvers.

Figure 7:
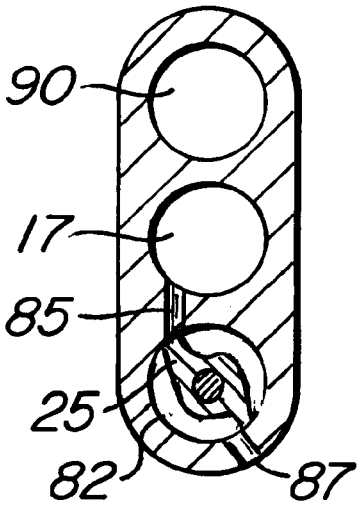
FIG. 7 shows the perspective end view of section lines 7 in FIG. 6.

FIG. 7 is a cross sectional view of the portion indicated by the section lines 7 in FIG. 6. Herein said impeller blades in chamber 82 are acted upon by combustion gases from barrel 17, by means of port 85, before venting through port 87.

FIG. 6 exposes a second gas operation of the present invention. Upon firing, port 94 provides means of combusting gasses to vent into chamber 97, applying compression pressure upon breech member 23. This unique gas operation may be employed to increase the downward pressures of springs 34, to ensure stability of the resultant breech formed in mating transport drum 11, and resilient breech member 23, until pressures in the firearm are reduced to safe levels from further employment and expulsion of expanding gasses.

In the preferred embodiment of the invention, the barrel (17) may be placed lower, relative to the handle of the firearm than with conventional designs, resulting in reduced perceived recoil. It is suggested in the preferred embodiment of the invention that a second vented barrel shape (part 90 in FIG. 6) be employed above the true barrel 17, and that traditional sights be mounted upon said vented barrel. The function of the second barrel being four fold; its dampening effect will further reduce perceived recoil from the firearm; it will function as a heat sink, preventing barrel 17 from distorting during successive firings; it may house or anchor accessories such as optional laser or optical sighting devices; and lastly, if it is desired that barrel 17 be ported to further prevent recoil, as is common to modern firearms, port 92 (FIG. 6.) provides a third gas operation, diverting expanding gasses upward to assist in the reduction of perceived recoil as commonly understood in modern firearms design. However, false barrel 90 will prevent escaping gasses from interfering with the operators vision as is common with conventional designs.

It should be noted that aspects of firearms design which are commonly understood to those versed in the art, are not discussed herein; so that a discussion of the present invention involves those features which are novel to the present invention. It should be further noted that while the preferred embodiment has described the use of a particular caliber and bullet shape, it should be apparent to anyone versed in the art, that a minor modification of the parts herein described will make the present invention functional for a multiplicity of calibers and bullet shapes, including parabolic ammunition, rifle cartridges, and caseless ammunition. Also, describing the transport drum as functioning in a clockwise manner, is arbitrary, and is not intended to imply that the design be so employed exclusively.

The inventor claims:

1. A firearm comprising:

a barrel;

a frame;

a transport drum disposed within said frame, said transport drum being rotatable about its axis and having at least one recess adapted to receive ammunition for movement of said ammunition from a loading position to a breech position and an ejection position by rotation of said transport drum;

at least one resilient breech member, additional to said frame and capable of moving laterally and in cooperation with said transport drum and said recess therein to define a breech within said firearm;

means to urge said at least one resilient breech member laterally into engagement with said transport drum during the firing cycle of the firearm and laterally out of engagement with said transport drum during the firearms ejection cycle; a trigger mechanism being manually operable to rotate said transport drum and ammunition therein from loading, to breech, and ejection positions; and a magazine for the storage of ammunition, connectable with said firearm and employing means whereby ammunition is placed into engagement with said transport drum recess in said transport drum during the loading cycle of said firearm.

2. A firearm having a barrel, a breech housing, a trigger mechanism, a transport drum disposed within said breech housing, said transport drum having at least one recess adapted to receive ammunition for transporting said ammunition from a loading position to a breech position, an additional resilient breech member acting within said breech housing wherein: said transport drum and said additional resilient breech member are individually and co-laterally articulated with regard to said firearms barrel, so as to form within said breech housing a breech suitable for ammunition of generally cylindrical configuration.

3. A firearm according to claim 1, wherein:

said frame has a contoured surface for movement therealong of ammunition in the said transport drum recess from a loading position to a breech and ejection position.

4. A firearm according to claim 2, wherein:

said breech housing has a contoured surface for movement therealong of ammunition in the said transport drum recess from a loading position to a breech and ejection position.

5. A firearm according to claim 1, wherein:

said means to laterally urge said at least one resilient breech member into engagement with said transport drum includes combustion gas pressure applied from said ammunition to said at least one resilient breech member via a passage communicating with said barrel.

6. A firearm according to claim 2, wherein:

said means to laterally urge said additional resilient breech member into engagement with said transport drum includes combustion gas pressure applied from said ammunition to said additional resilient breech member via a passage communicating with said barrel.

7. A firearm according to claim 2, and further comprising:

a shaft rotatably mounted axially of said transport drum in generally parallel relation to said barrel, at least one impeller blade on the shaft spaced from the transport drum, and means defining an opening in said barrel adjacent the at least one impeller blade for rotation of the shaft by combustion gases applied to the impeller blade to rotate the transport drum to move the transport drum to its breech position without further manual operation of the trigger mechanism.

8. In a firearm having an open chamber, a barrel, a trigger mechanism and a breech, the combination comprising:

a transport drum rotatable about its axis and having at least one recess adapted to receive a cartridge for movement from a loading position to a cartridge breech position by rotation of the transport drum, a shaft mounted axially of the transport drum and in generally parallel relation with said barrel, said shaft having thereon at least one impeller blade spaced from the transport drum, and means defining an opening through said barrel adjacent the at least one impeller blade to rotate said shaft by combustion gases applied thereto via said opening to rotate the transport drum for movement thereof to a breech position to place another cartridge in breech position without actuation of said trigger mechanism.

9. A firearm having a barrel, a breech housing, a trigger mechanism, a transport drum and at least one resilient breech member acting independently of said breech housing wherein:

said transport drum is disposed within said breech housing, said transport drum being rotatable about its axis and having at least one recess adapted to receive a cartridge for transporting said cartridge from a loading position to a breech position;

said at least one resilient breech member is capable of acting in cooperation with said transport drum and said recess therein, and within said breech housing to define a breech;

mechanical means are employed to resiliently urge said at least one resilient breech member into lateral engagement with said transport drum to define said breech, between said breech housing, resilient breech member and said transport drum;

said trigger mechanism being manually operable to rotate said transport drum from its loading position to a breech, and ejection position.

10. A resilient breech firearm comprised of:

at least one barrel;

a transport drum of generally cylindrical contour with at least one recess for ammunition arranged radially to said barrel, said transport drum being mounted for rotation upon its cylinder axis;

a frame having a generally contoured surface for movement therealong of ammunition in the said transport drum recess from a loading position to a breech and ejection position;

at least one resilient breech member, additional to said frame and capable of lateral movement with regard to said firearms barrel(s), for the purpose of engaging said transport drum to form a breech during the firing cycle of the firearm, and disengaging said transport drum to enable an ejection cycle;

means to laterally urge said at least one resilient breech member into engagement with said transport drum, including combustion gas pressure applied from said ammunition in said breech to said resilient breech member(s) via a passage communicating with said at least one barrel, whereby said ammunition's gas pressure acts upon said at least one resilient breech member to stabilize said breech against outwardly expanding pressure from said ammunition;

a trigger mechanism; and a magazine for the storage of ammunition, connectable with said resilient breech firearm and employing means whereby ammunition is placed into engagement with said transport drum recess in said transport drum during the loading cycle of said firearm.

11. A resilient breech firearm in accordance with claim 10, wherein:

said ammunitions expanding gasses are employed via an opening in said at least one barrel to supply lateral movement with regard to said barrel of said transport drum and said at least one resilient breech member without further manual operation of said trigger.

* * * * *